United States Patent [19]

Muzyka et al.

[11] 4,006,011

[45] Feb. 1, 1977

[54] CONTROLLED EXPANSION ALLOY

[75] Inventors: Donald R. Muzyka, Reinholds; Donald K. Schlosser, Reading, both of Pa.

[73] Assignee: Carpenter Technology Corporation, Reading, Pa.

[22] Filed: Feb. 26, 1974

[21] Appl. No.: 445,963

Related U.S. Application Data

[60] Continuation-in-part of Ser. No. 292,537, Sept. 27, 1972, abandoned, which is a division of Ser. No. 142,635, May 12, 1971, Pat. No. 3,705,827, and Ser. No. 314,113, Dec. 11, 1972, abandoned, which is a continuation-in-part of Ser. No. 142,635, May 12, 1971, Pat. No. 3,705,827.

[52] U.S. Cl. ..... 75/122; 75/123 K; 75/134 F

[51] Int. Cl.[2] ..... C22C 30/00

[58] Field of Search ..... 75/122, 123 R, 123 K, 75/134 F, 124, 170, 171; 148/32, 32.5, 162, 142

[56] References Cited

UNITED STATES PATENTS

| | | | |
|---|---|---|---|
| 2,542,962 | 2/1951 | Kinsey | 75/170 |
| 2,570,194 | 10/1951 | Bieber et al. | 148/162 |
| 3,048,485 | 8/1962 | Bieber | 148/162 X |
| 3,157,495 | 11/1964 | Eiselstein et al. | 75/170 X |
| 3,420,660 | 1/1969 | Kawahata et al. | 75/122 |
| 3,514,284 | 5/1970 | Eiselstein | 75/123 R |
| 3,575,734 | 4/1971 | Muzyka et al. | 148/162 |
| 3,705,827 | 12/1972 | Muzyka et al. | 148/142 |

FOREIGN PATENTS OR APPLICATIONS

| | | | |
|---|---|---|---|
| 1,315,270 | 12/1962 | France | 75/123 R |

*Primary Examiner*—C. Lovell
*Attorney, Agent, or Firm*—Edgar N. Jay

[57] ABSTRACT

Precipitation hardenable or hardened nickel-cobalt-iron base alloy containing nickel, cobalt, iron, columbium, titanium, aluminum and boron as the only essential elements, characterized by a mean coefficient of linear expansion of about $3\times10^{-6}/°$ F to $6\times10^{-6}/°$ F from room temperature to its Curie temperature of at least about 600° F to 1000° F or higher. The alloy contains about 35–45% nickel, 13–18% cobalt, 2.5–7.0% columbium, 1.0–4.0% titanium, 0.1–2% aluminum, and a small but essential amount of boron.

12 Claims, No Drawings

CONTROLLED EXPANSION ALLOY

CROSS-REFERENCES

This application is a continuation-in-part of our copending applications Ser. No. 292,537, filed Sept. 27, 1972 and Ser. No. 314,113 filed Dec. 11, 1972 which (now abandoned) in turn were, respectively, a division and a continuation-in-part of our application Ser. No. 142,635, filed May 12, 1971, granted as patent No. 3,705,827 on Dec. 12, 1972, and assigned to the assignee of the present application.

BACKGROUND OF THE INVENTION

This invention relates to a nickel-cobalt-iron base alloy containing, columbium, titanium, aluminum and boron and, more particularly, to such an alloy in which the elements are critically balanced to provide a unique combination of controlled expansion and high-temperature properties, including stress rupture ductility in parts or shapes which are subjected to elevated temperatures during fabrication and/or use.

In the copending application of Donald R. Muzyka and Donald K. Schlosser, granted on Dec. 12, 1972 as U.S. Pat. No. 3,705,827 and assigned to the assignee of the present application, there is disclosed a method of heat treating nickel-iron base alloys, including controlled expansion-type alloys, according to which solution treatment of the alloy is carried out above the effective solvus temperature of the gamma prime and/or gamma double prime phases present in the composition but below the effective solvus temperature of the eta and/or delta phases. Such terms as gamma prime, gamma double prime, eta and delta phases, solvus and effective solvus temperatures as well as others are defined in said U.S. Pat. No. 3,705,827, and the disclosure of the patent is expressly incorporated here by reference in order to avoid repeating those definitions and the details of the heat treatment here. As is brought out in said patent, the heat treatment therein disclosed and claimed is applicable to a large velocity or nickel-iron base alloys, with or without cobalt, including controlled expansion-type alloys, strengthened by precipitation hardening in which the elements columbium, titanium, and aluminum take part in the main strengthening reaction.

This application is directed to the unique controlled expansion alloy disclosed in said U.S. Pat. No. 3,705,827 as well as further discoveries we have made and disclosed in our said copending application Ser. No. 314,113 which provides alloys that are balanced to withstand higher fabricating temperatures such as are encountered where such bonding techniques as brazing are used. It is necessary in the fabrication of parts prepared from alloys heat treated in accordance with the process of said U.S. Pat. No. 3,705,827 that they not be exposed during fabrication to temperatures high enough and long enough above the solvus temperature of the eta and delta phases to bring about undesired solutioning of such phases, one of the detrimental effects which the heat treatment of said patent is intended to avoid.

SUMMARY OF THE INVENTION

It is, therefore, a principal object of this invention to provide a controlled expansion-type nickel-cobalt-iron base alloy containing columbium, titanium, aluminum and boron characterized by a unique combination of properties, particularly when heat treated in accordance with said U.S. Pat. No. 3,705,827.

A more specific object is to provide such a composition having an effective eta phase and delta phase solvus temperature higher than the temperature to which parts or shapes thereof would be subjected during fabrication when high temperature bonding techniques such as brazing are employed involving temperatures as high as about 1800° F.

DESCRIPTION OF THE PREFERRED EMBODIMENT

The foregoing, as well as additional objects and advantages of the present invention, are achieved by providing a nickel-cobalt-iron base alloy containing the following elements in the amounts indicated in the broad and preferred ranges given in approximate percent in Table I. Here and elsewhere throughout this application, by proportions in percent is intended weight percent unless otherwise indicated.

TABLE I

| | Broad | Intermediate | Preferred A | Preferred B |
|---|---|---|---|---|
| Carbon | 0.1* | 0.1* | 0.01–0.05 | 0.01–0.05 |
| Manganese | 0.50* | 0.50* | 0.20* | 0.20* |
| Silicon | 0.50* | 0.50* | 0.20* | 0.20* |
| Phosphorus | 0.020* | 0.020* | 0.020* | 0.020* |
| Sulfur | 0.020* | 0.020* | 0.020* | 0.020* |
| Nickel | 35–45 | 35–40 | 36–39 | 38–42 |
| Cobalt | 13–18 | 13–17 | 14.5–16.5 | 15–17 |
| Columbium | 2.5–7.0 | 2.5–6 | 2.75–3.2 | 4–6 |
| Titanium | 1.0–4.0 | 1–3 | 1.65–1.85 | 2.5–3.5 |
| Aluminum | 0.1–2 | 0.1–2 | 0.85–1.5 | 0.75–1.5 |
| Boron | .003–0.030 | 0.003–.020 | 0.003–0.020 | 0.003–0.020 |
| Vanadium | 1* | | | |
| Zirconium | 0.1* | | | |
| Hafnium | 2* | | | |

*Maximum

The balance of the composition is iron except for incidental impurities which, preferably, are kept low. For example, the compositions of the present invention are advantageously treated according to the process of U.S. Pat. No. 3,575,734, and this may result in the presence of a small amount of one or more elements such as magnesium and calcium, preferably no more than about 0.01%. Elements such as chromium, molybdenum and tungsten are not considered desirable additions, and each is preferably limited to no more than 0.5%.

The only essential elements in the composition of the present invention are the elements nickel, cobalt, columbium, titanium, aluminum, boron and iron. These elements are proportioned to provide a composition especially well suited for making parts for use in environments where they are to be subjected to repeated temperature cycling to an elevated temperature with or without stress, as for example in gas turbine engines. Within the ranges stated, the elements are balanced to provide a unique combination of elevated temperature properties, particularly tensile ductility and stress rupture life and ductility together with desirably controlled expansion characteristics.

While the essential elements are carefully balanced in accordance with the ranges specified in Table I, to provide the best all-around compositions of this invention, it is not intended to exclude the possibility of combining the broad or intermediate range of one or more of the indicated elements with the preferred amounts of one or more of the remaining elements.

The nickel, cobalt and iron coact in this composition to provide an austenitic or gamma face centered cubic microstructure. And this composition is one which remains austenitic and does not transform to martensite even when subjected to a temperature as low as −100° F. Broadly stated, nickel can range from about 35 to 45%, and cobalt can range from about 13 to 18%.

The strengthening elements columbium, titanium and aluminum react with some of the nickel to form one or more strengthening passes brought out as an intragranular precipitate by age or precipitation hardening. The composition of those phases is generalized as $Ni_3$ (Cb, Ti, Al) and may include gamma prime and/or gamma double prime, the structure of which is described more fully in said U.S. Pat. No. 3,705,827.

In this composition, the elements nickel, cobalt, columbium, aluminum, and titanium coact to control the Curie temperature and expansion properties of the composition. In addition, the columbium and titanium contents largely affect the solvus temperatures of the gamma prime and double prime phases and of the eta and delta phases. Boron contributes to the stress rupture ductility.

To provide a mean coefficient of linear expansion ($alpha_1$) of about $3\times10^{-6}$/°F to $6\times10^{-6}$/°F from room temperature up to a Curie temperature or inflection temperature ($T_c$) ranging from about 600° F to 1000° F or higher, the composition is balanced within the foregoing intermediate range so as to satisfy the following two equations in which percents are also by weight:

$$T_c = 38.1\,(\%Ni) + 43.8\,(\%Co) - 92.0\,(\%Al) - 44.7\,(\%Ti) - 16.8\,(\%Cb) - 1084.6$$

$$Alpha_1 = .319\,(\%Ni) + .271\,(\%Co) - .643\,(\%Al) - .281\,(\%Ti) - .163\,(\%Cb) - 10.557$$

Preferably, the composition is balanced within the preferred range A, and better yet, so as to provide a value of $alpha_1$ of $4.0\times10^{-6}$ to $4.5\times10^{-6}$/°F and a Curie temperature range of 760° F to 860° F.

When the parts to be made from the composition are to be subjected during fabrication to relatively high temperatures, the composition is preferably balanced in accordance with preferred range B and to provide a mean coefficient of linear expansion ($alpha_1$) of about $3\times10^{116\ 6}$/°F to $6\times10^{-6}$/°F from room temperature up to a Curie temperature or inflection temperature ($T_c$) ranging from about 600° F to 1000° F or higher, the composition is balanced within that range so as to satisfy the following two equations:

$$T_c = 36.9\,(\%Ni) + 38.9\,(\%Co) - 89.9\,(\%Al) - 73.1\,(\%Ti) - 22.9\,(\%Cb) - 859.5$$

$$Alpha_1 = .294\,(\%Ni) + .162\,(\%Co) - .412\,(\%Al) - .337\,(\%Ti) - .101\,(\%Cb) - 8.246$$

Preferably, the composition is balanced within preferred range B so as to provide a value of $alpha_1$ of $4.0\times10^{-6}$ to $4.5\times10^{-6}$/°F and a Curie temperature range of 760° to 860° F.

Thus, depending upon the properties desired, from about 2.5 to 7.0% columbium, 1.0 to 4.0% titanium and 0.1 to 2% aluminum can be present in this composition. Though aluminum is not one of the main strengthening elements, some small amount is necessary, and the minimum amount required should be increased as the columbium content tends toward the lower end of its range. When the amount of columbium present is about 2.5 to 3.0%, the minimum amount of aluminum preferably should not be less than about 0.15% and, better yet, not less than about 0.20%.

Boron is a required element in this composition to ensure attainment of the improved stress rupture properties provided by the process of said U.S. Pat. No. 3,705,827. To that end, a small but definite amount of at least about 0.003% boron is required, but no more than 0.030% should be used. Preferably, at least about 0.005 to 0.020% boron is included, and, for best results, boron is limited to 0.015%.

Optional elements that can be included are up to about 1% vanadium for its beneficial effect on the hot workability of a particular analysis, up to about 0.1% zirconium for its beneficial effect on ductility, and up to 2% hafnium for its effect as a solid solution strengthener and as a carbide former.

In keeping with good commercial metallurgical practice, up to about 0.1% carbon may be present. The expense involved in keeping carbon below a few hundredths of a percent must be weighed against the advantage to be gained, and, in some instances, about 0.01 to 0.05% carbon can be beneficial. Phosphorus and sulfur are not desirable additions, and preferably each does not exceed about 0.020%. Such elements as chromium, molybdenum and tungsten also are not desirable additions and should not exceed about 0.5%.

The alloy of the present invention is readily melted and cast as ingots using conventional techniques; however, for best results, a multiple melting practice is preferred. For example, a heat can be first melted and cast as an ingot under vacuum in an induction furnace, and that ingot is then used as a consumable electrode and remelted under vacuum. As was noted hereinabove, the process of said U.S. Pat. No. 3,575,734 is advantageously used, the treatment with magnesium or calcium being preferred.

In forming and heat treating the present composition, hot working is preferably carried out so as to provide a fine grain structure of at least A.S.T.M. 4 or finer. In practice, forging from a furnace temperature of about 2000° F to 2100° F to at least about 60% reduction in cross-sectional area is adequate, but reductions of as much as 80 to 90% provide better results. For optimum results, it is preferred that the final forging operations be carried out at least in part within about 100° F, above or below, of the effective solvus temperature of the eta and delta phases of the composition. This ensures the desired grain structure of no coarser than A.S.T.M. 4. The starting grain structure for heat treatment which is believed to give best results is at least as fine as A.S.T.M. 8 or finer.

As brought out in said U.S. Pat. No. 3,705,827, solution treatment of the present composition in accordance with the process of said patent serves several functions including the usual one of putting back into solution the intragranular strengthening gamma prime and double prime phases brought out during hot working. Another and important function of the solution treatment of the process is the formation of the eta phase and/or delta phase precipitate along the grain boundaries. The solution treatment is carried out at a temperature and for a time long enough to provide the amount and also the distribution of the eta and delta phases which favors the attainment of elevated temperature tensile and stress rupture ductility. The best treating temperature for each analysis is readily determined empirically as described in said U.S. Pat. No. 3,705,827.

Furthermore, in this composition the columbium and titanium contents significantly affect the solvus temperatures of the gamma prime and double prime phases and the eta and delta phases. By taking into account and adjusting the combined amount of columbium and titanium within the broad range, the gamma prime and double prime solvus temperature can be adjusted from about 1450° F to 1800° F or higher, and the eta and delta phase solvus temperature can be adjusted from 1550° F to 2000° F or higher. In calculating the combined effect of columbium and titanium, 1.5 times the atomic percent of columbium is added to the atomic percent of titanium contained in the composition. Because of the effect of segregation and inherent limits in the precision of the measurements involved, those temperatures may vary by plus or minus 50° F. Thus, with 1.65 to 1.85% titanium and 2.75 to 3.2% columbium, the gamma prime and double prime solvus temperature can be adjusted from about 1550° to 1600° F and the eta and delta phase solvus temperature can be adjusted from about 1625° to 1700° F. With 2.5 to 3.5% titanium and 4–6% columbium, the gamma prime and double prime solvus temperature can be adjusted from about 1675° to 1750° F and the eta and delta phase solvus temperature can be adjusted from about 1790° to 1930° F.

exclude is to be noted that by the term "hot working" it is not intended to exlude "warm working", which includes working the metal while it is below its recrystallization temperature, or other thermo-mechanical procedures. It should also be noted that, for the compositions of the present invention, the effective solvus temperature of the eta and delta phases is the recrystallization temperature of the alloy for most practical purposes, but, in some instances, following extreme warm working, the recrystallization temperature can be lower.

EXAMPLE 1

As an example of a controlled expansion alloy of the present invention within preferred range A, an experimental vacuum induction heat having the following composition in weight percent was prepared:

| | |
|---|---|
| Carbon | 0.032 |
| Manganese | 0.01 |
| Silicon | 0.01 |
| Nickel | 38.35 |
| Cobalt | 16.02 |
| Columbium | 2.77 |
| Titanium | 1.76 |
| Aluminum | 1.05 |
| Boron | 0.0049 |

The balance was iron and incidental impurities which included no more than 0.001% phosphorus, no more than 0.001% sulfur, less than 0.1% chromium, and less than 0.1% molybdenum. The ingot was forged to bar stock which was then used for making test blanks which were heat treated, machined and tested. In addition to stress rupture test specimens, 1200° F tensile specimens having a 0.252 in. diameter and a 1.0 in. long gage section were also prepared. Solution treatment of all of the specimens was for 1 hour at the temperature indicated followed by aging at 1325° F for 8 hours, then cooling at the rate of 100° F per hour to 1150° F, holding that temperature for 8 hours and then cooling in air. The effect of solution-treating temperatures from 1550° F to 1700° F on the stress rupture properties of the alloy of Example 1 measured at 1150° F under a load of 110,000 psi are set forth in the following table.

TABLE II

| Soln. Temp. (° F) | Rupt. life (hrs.) | El. (%) | R.A. (%) |
|---|---|---|---|
| 1,550 | 22.6 | 15.5 | 54.0 |
| 1,575 | 158.3 | 11.7 | 44.4 |
| 1,600 | 237.3 | 14.3 | 37.3 |
| 1,625 | 305.3 | 12.3 | 30.8 |
| 1,650 | 4.3 | 1.4 | 2.0 |
| 1,675 | 2.9 | 1.4 | — |
| 1,700 | 172.6 | 1.4 | 3.2 |

The foregoing data demonstrates that the effective solvus temperature of the eta and delta phases in this composition occurs between about 1625° F and 1650° F for such solution treatments. While useful properties can still be obtained by solution treating for 1 hour at 1575° F, 1550° F is too low probably because it is below the effective solvus temperature of the gamma prime and gamma double prime phases.

The results of tensile tests carried out at 1200° F on specimens subjected to the same heat treatments as those to which the stress rupture specimens just described were subjected are set forth in the following table.

TABLE III

| Soln. Temp. (° F) | .2% Y.S. (ksi) | U.T.S. (ksi) | El. (%) | R.A. (%) |
|---|---|---|---|---|
| 1,550 | 140.1 | 152.3 | 26.3 | 63.6 |
| 1,575 | 147.2 | 161.3 | 20.2 | 60.0 |
| 1,600 | 146.5 | 158.1 | 22.6 | 56.8 |
| 1,625 | 148.1 | 164.3 | 22.1 | 54.5 |
| 1,650 | 137.3 | 161.5 | 15.0 | 22.3 |
| 1,675 | 132.9 | 158.2 | 11.6 | 18.9 |
| 1,700 | 130.9 | 155.0 | 10.0 | 19.7 |

For this composition, optimum elevated temperature properties are provided by a solution-treating temperature of about 1575° F to 1625° F, the effect being mainly on the 0.2% yield strength (0.2% Y.S.) rather than the ultimate tensile Strength (U.T.S.).

For comparison purposes, a heat was prepared as described in connection with Example 1 having an equivalent analysis except that the boron content was 0.0022% and containing 0.031% carbon, 37.73% nickel, 16.19% cobalt, 3.02% columbium, 1.74% titanium, 1.00% aluminum, and the balance iron except for inconsequential impurities. Two stress rupture specimens were prepared which were solution treated at 1625° F for 1 hour followed by primary aging at 1325° F and final aging at 1150° F as was described in connection with Example 1. When subjected to a stress of 110 ksi at 1150° F, both specimens failed at the notch one after only 1.2 hours and the other after only 2.1 hours.

EXAMPLE 2

As a further example of a controlled expansion alloy in accordance with the intermediate range of this invention, a vacuum induction heat was prepared as described in connection with Example 1 having the following composition in weight percent:

| | |
|---|---|
| Carbon | 0.031 |
| Manganese | 0.01 |
| Silicon | <0.01 |
| Nickel | 37.44 |
| Cobalt | 13.99 |
| Columbium | 3.10 |
| Titanium | 1.53 |
| Aluminum | 0.58 |
| Boron | 0.0047 |

The balance was iron and incidental impurities which included less than 0.1% each of chromium and molybdenum, and no more than 0.001% each of phosphorus and sulfur. Combination smooth/notch stress rupture specimens prepared from the composition of Example 2 as was described in connection with Example 1, were subjected to a stress of 110,000 psi at a temperature of 1150° F, and the results are set forth in Table IV.

TABLE IV

| | Rupt. life | El. | R.A. |
|---|---|---|---|
| Soln. Temp. (° F) | (hrs.) | (%) | (%) |
| 1,550 | 103.3 | 13.8 | 48.2 |
| 1,575 | 119.4 | 14.3 | 45.9 |
| 1,600 | 113.0 | 14.7 | 48.3 |
| 1,625 | 13.6 | * | * |
| 1,650 | 2.6 | * | * |
| 1,675 | 1.5 | * | * |
| 1,700 | 0.6 | * | * |

*Notch breaks

Except for the critical amount of boron present therein, the alloy of Example 2 corresponds to that of U.S. Pat. No. 3,157,495. The unique stress rupture ductility provided by the present invention is clearly brought out by the data in Table IV. It may be noted that the difference in the aluminum content of about 0.5% between the compositions of Example 1 and Example 2 is believed to account for the difference in optimum solution-treating temperatures between the two alloys, that of Example 1 being higher because of the greater amount of aluminum.

For comparison with Example 2, a composition of said U.S. Pat. No. 3,157,495 was prepared as described in connection with Example 2 and having the following analysis in weight percent:

| | |
|---|---|
| Carbon | 0.032 |
| Manganese | 0.02 |
| Silicon | 0.01 |
| Nickel | 36.77 |
| Cobalt | 14.08 |
| Columbium | 2.94 |
| Titanium | 1.51 |
| Aluminum | 0.55 |
| Boron | 0.0005 |

The balance was iron and incidental impurities which included 0.004% phosphorus, 0.001% sulfur, 0.04% chromium, and less than 0.01% molybdenum. Combination smooth/notch stress rupture specimens were prepared as was described in connection with Example 2 and after being solution treated at 1575° F for 1 hour and subjected to the same aging treatment as the specimens of Example 2, the specimens were subjected to a load of 110,000 psi at 1150° F. One specimen failed after only 0.9 hour with 10.3% elongation and 18.0% reduction in area, indicating a stress rupture life which is too short to be acceptable. When specimens of this composition were solution treated at 1625° F but otherwise treated and tested in the same way as was just described, all specimens suffered notch breaks indicating that they did not have stress rupture ductility, as was expected.

As illustrative of the controlled expansion alloy of preferred range B of the present invention, the following four examples were prepared as experimental vacuum induction heats having the following composition in weight percent (w/o) and atomic percent (a/o):

TABLE V

| | Ex. 3 | | Ex. 4 | | Ex. 5 | | Ex. 6 | |
|---|---|---|---|---|---|---|---|---|
| | w/o | a/o | w/o | a/o | w/o | a/o | w/o | a/o |
| C | .036 | .173 | .035 | .169 | .034 | .164 | .032 | .152 |
| Ni | 39.91 | 39.11 | 40.02 | 39.43 | 38.34 | 37.77 | 41.32 | 40.23 |
| Co | 15.92 | 15.55 | 16.24 | 15.95 | 15.93 | 15.64 | 16.04 | 15.56 |
| Cb | 4.97 | 3.08 | 6.00 | 3.74 | 5.00 | 3.11 | 4.39 | 2.70 |
| Ti | 2.87 | 3.45 | 2.49 | 3.01 | 2.97 | 3.59 | 2.97 | 3.54 |
| Al | 1.03 | 2.19 | 1.04 | 2.23 | .50 | 1.07 | 1.51 | 3.20 |
| B | .008 | .045 | .009 | .048 | .009 | .047 | .008 | .040 |
| Fe | 35.21 | 36.30 | 34.16 | 35.41 | 37.16 | 38.51 | 33.71 | 34.53 |

As incidental impurities, Examples 3–6 each contained by weight less than 0.01% manganese, less than 0.1% silicon, less than 0.005% phosphorus or sulfur, no more than about 0.01% chromium, and less than 0.01% molybdenum. Prior to casting as ingots, 0.05% calcium was added as calcium metal to each of the examples, and each heat was then subjected to low pressure in accordance with U.S. Pat. No. 3,575,734. Thus, each example contained 0.003% calcium. The four heats were cast into 2¾ in. sq. ingots which were homogenized and then forged from a temperature of 2050° F to 1½ in. sq., reheated to 2050° F followed by forging to 1 in. sq., reheated to 2050° F and forged to ⅝ in. sq. bars.

The solvus temperature of Examples 3–6 for the gamma prime and gamma double prime phases and that of the eta and delta phases are indicated in Table VI. The solution treating temperature selected for each example is also indicated. The gamma prime and double prime solvus temperatures and the eta and delta solvus temperatures must be considered as approximate (plus or minus 25° F) because of the segregated structures usually encountered in small experimental heats.

TABLE VI

| Ex. No. | Solvus Temperature ° F: Gamma prime & Double prime | Eta & Delta | Solution Temp. ° F |
|---|---|---|---|
| 3 | 1700 | 1840 | 1800 |
| 4 | 1675 | 1845 | 1800 |
| 5 | 1675 | 1835 | 1775 |
| 6 | 1725 | 1830 | 1775 |

Specimens of each example for determining the Curie temperatures and the average coefficient of thermal expansion over the ranges indicated in Table VII were prepared from material which had been heat treated by solution treating for 1 hour at the temperature indicated in Table VI, cooling in air and then precipitation hardening by heating at 1325° F for 8 hours, cooling 100° F/hr. down to 1150° F where they were held for 8 hours and then allowed to cool in air. The specimens prepared were standard dilatometer specimens 0.180 in. round by 2 in. long, but the thermocouples were attached to the exterior of each specimen instead of being inserted in holes.

TABLE VII

| Ex. No. | Curie Temp. ° F | Average Coefficient of Thermal Expansion ($\times 10^{-6}$/° F): 75° F to Curie | 75° F to 1300° F | Curie to 1300° F |
|---|---|---|---|---|
| 3 | 830 | 4.22 | 5.80 | 8.33 |
| 4 | 875 | 4.22 | 5.82 | 8.36 |
| 5 | 845 | 4.07 | 5.61 | 10.90 |
| 6 | 835 | 4.32 | 5.79 | 9.25 |

Test specimens having a 0.252 in. gage diameter were prepared for carrying out room temperature tensile tests, and combination smooth/notch rupture specimens with a stress concentration factor of 3.8 at the notch were prepared for carrying out stress rupture tests at 1200° F. The results of the room temperature tests are indicated in Table VIII-A and B where, for each example, the 0.02% and 0.2% yield strength (Y.S.) and ultimate tensile strength (U.T.S.) in thousand pounds per square inch (ksi) and the hardness, on the Rockwell C (Rc) scale, of the specimens as tested are indicated. All specimens were solution treated for one hour at the temperature indicated in Table VI. The results indicated in Table VIII-A were obtained on specimens which, after solution treatment, were subjected to the precipitation hardening treatment described in connection with the dilatometer specimens. The specimens tested for the results indicated in Table VIII-B were subjected to a two-stage aging treatment. The specimens of Exs. 3, 4 and 5 were first aged at 1550° F for 4 hours followed by air cooling, final aging at 1250° F for 16 hours and then air cooling. The specimens of Ex. 6 were aged in the same way except that the final aging was at 1325° F.

TABLE VIII-A

| Ex. No. | .02% Y.S. (ksi) | .2% Y.S. (ksi) | U.T.S. (ksi) | El. (%) | R.A. (%) | Hardness Rc |
|---|---|---|---|---|---|---|
| 3 | 185.6 | 223.1 | 253.5 | 4.4 | 8.0 | 49/49 |
| | 179.2 | 217.8 | 251.9 | 4.5 | 7.4 | |
| 4 | 185.9 | 220.3 | 250.5 | 3.9 | 5.9 | 49/50 |
| | 186.2 | 219.9 | 251.3 | 2.9 | 4.7 | |
| 5 | 162.3 | 208.4 | 243.3 | 2.8 | 6.3 | 48/50 |
| | 173.8 | 211.2 | 242.7 | 3.6 | 7.0 | |
| 6 | 178.9 | 218.7 | 249.3 | 3.8 | 7.0 | 49/51 |
| | 183.2 | 220.3 | 254.1 | 4.6 | 10.4 | |

TABLE VIII-B

| Ex. No. | .02% Y.S. (ksi) | .2% Y.S. (ksi) | U.T.S. (ksi) | El. (%) | R.A. (%) | Hardness Rc |
|---|---|---|---|---|---|---|
| 3 | 161.6 | 190.0 | 212.5 | 3.6 | 5.5 | 44 |
| 4 | 149.5 | 180.8 | 200.0 | 2.5 | 5.5 | 44 |
| 5 | 141.3 | 173.7 | 201.6 | 4.3 | 7.6 | 44 |
| 6 | 141.4 | 167.7 | 200.4 | 4.4 | 6.8 | 42 |

The elevated temperature (1200° F) tensile tests were carried out on specimens having a 0.357 in. round gage diameter, and the results are indicated in Tables IX-A and B. The heat treatment of the specimens for the results indicated in Table IX-A was the same solution treatment as in Table VI followed by the same precipitation hardening treatment used on the room temperature tensile test specimens reported in Table VIII-A. The elevated temperature tensile test data reported in Table IX-B was obtained from specimens subjected to the same heat treatment as the specimens tested for Table VIII-B.

TABLE IX-A

| Ex. No. | .02% Y.S. (ksi) | .2% Y.S. (ksi) | U.T.S. (ksi) | El. (%) | R.A. (%) |
|---|---|---|---|---|---|
| 3 | 139.0 | 159.9 | 188.7 | 16.7 | 26.9 |
| | 134.1 | 162.6 | 190.9 | 20.6 | 42.2 |
| 4 | 142.8 | 167.8 | 193.9 | 12.5 | 22.0 |
| | 140.3 | 167.6 | 196.6 | 10.0 | 19.2 |
| 5 | 122.5 | 159.0 | 185.0 | 17.8 | 42.8 |
| | 134.2 | 159.5 | 185.8 | 18.3 | 49.4 |
| 6 | 133.8 | 166.3 | 190.5 | 13.4 | 20.6 |
| | 135.0 | 163.8 | 191.3 | 14.2 | 28.4 |

TABLE IX-B

| Ex. No. | .2% Y.S. (ksi) | U.T.S. (ksi) | El. (%) | R.A. (%) | Hardness Rc |
|---|---|---|---|---|---|
| 3 | 140.7 | 169.3 | 21.1 | 55.7 | 44 |
| 4 | 135.4 | 161.7 | 28.8 | 65.3 | 44 |
| 5 | 142.5 | 168.3 | 19.9 | 47.7 | 44 |

TABLE IX-B-continued

| Ex. No. | .2% Y.S. (ksi) | U.T.S. (ksi) | El. (%) | R.A. (%) | Hardness Rc |
|---|---|---|---|---|---|
| 6 | 122.3 | 158.6 | 28.5 | 63.2 | 42 |

The stress rupture test data from the smooth/notch stress rupture specimens are indicated in Tables X-A and Table X-B. The specimens of Table X-A were subjected to the same heat treatment as that used on the specimens of Table IX-A. The heat treatment of the Table X-B specimens was the same as that of the Table IX-B specimens.

TABLE X-A

| Ex. No. | 1200° F/stress (ksi) | Stress Rupture Life (hrs.) | Elong. (%) | R.A. (%) |
|---|---|---|---|---|
| 3 | 105 | 361.9 | 11.8 | 22.1 |
| | 110 | 215.8 | 4.3 | 8.9 |
| 4 | 105 | 164.4 | 0.8 | 1.2 |
| | 105 | 220.0 | 11.3 | 35.7 |
| 5 | 105 | 96.5 | 5.4 | 10.9 |
| | 105 | 106.1 | 12.0 | 34.5 |
| 6 | 105 | 132.8 | 0.7 | 2.0 |
| | 105 | 428.3 | 12.5 | 38.1 |

TABLE X-B

| Ex. No. | 1200° F/stress (ksi) | Stress Rupture Life (Hrs.) | Elong. (%) | R.A. (%) |
|---|---|---|---|---|
| 3 | 100 | 22.1 | 18.1 | 52.4 |
| | 95 | 102.3 | 17.6 | 45.7 |
| 4 | 95 | 49.7 | 15.7 | 35.7 |
| | 90 | 104.0 | 9.1 | 10.8 |
| 5 | 100 | 9.9 | 19.8 | 49.1 |
| | 95 | 24.3 | 21.4 | 56.2 |
| 6 | 85 | 357.3 | 27.3 | 47.0 |
| | 90 | 401.0 | 16.1 | 33.3 |

From the foregoing examples, it is apparent that, within preferred range B of the present invention, the composition containing about 41% nickel, 16% cobalt, 5% columbium, 3% titanium, and 1.25% aluminum has particularly useful controlled expansion properties and high temperature properties.

To illustrate further the present invention, the following five examples were prepared as experimental vacuum induction heats having the following composition in weight percent:

TABLE XI

| | 7 | 8 | 9 | 10 | 11 |
|---|---|---|---|---|---|
| C | .032 | .030 | .032 | .031 | .031 |
| Ni | 41.65 | 37.88 | 38.37 | 38.58 | 40.87 |
| Co | 13.91 | 17.68 | 16.33 | 15.97 | 17.37 |
| Cb | 4.75 | 4.44 | 6.37 | 4.62 | 6.35 |
| Ti | 2.45 | 2.57 | 1.52 | 3.56 | 3.44 |
| Al | 1.53 | 1.03 | 1.00 | 0.52 | 0.99 |
| B | .005 | .0067 | .0065 | .0074 | .0063 |
| Fe | 35.58 | 36.27 | 36.31 | 36.55 | 30.79 |

As incidental impurities, Examples 7–11 contained less than 0.01% manganese, less than 0.15% silicon except for Example 9 which contained 0.15% silicon, less than 0.005% phosphorus or sulfur, less than 0.01% chromium, and no more than about 0.01% molybdenum. The five heats were prepared, cast and forged as was described in connection with Examples 3–6 except that the ingots were forged without first being homogenized.

The solvus temperature of Examples 7–11 for the gamma prime and double prime phases and that of the eta and delta phases are indicated in Table XII. The solution-treating temperature selected for each example is also indicated.

TABLE XII

| Ex. No. | Solvus Temperature ° F Gamma Prime & Double Prime | Eta & Delta | Solution Temp. ° F |
|---|---|---|---|
| 7 | 1700 | 1820 | 1730 |
| 8 | 1670 | 1780 | 1700 |
| 9 | 1670 | 1825 | 1700 |
| 10 | 1780 | 1860 | 1825 |
| 11 | 1760 | 1925 | 1900 |

The Curie temperatures and average coefficient of thermal expansion over the ranges indicated in Table XIII were determined as was previously described in connection with Examples 3–6.

TABLE XIII

| Ex. No. | Curie Temp. ° F | Average Coefficient of Thermal Expansion ($\times 10^{-6}$/° F) 75° F to Curie | 75° F to 1000° F | Curie to 1000° F |
|---|---|---|---|---|
| 7 | 810 | 4.63 | 5.20 | 7.43 |
| 8 | 812 | 4.12 | 4.80 | 7.43 |
| 9 | 802 | 4.34 | 5.00 | 7.44 |
| 10 | 785 | 4.07 | 4.86 | 7.50 |
| 11 | 820 | 4.70 | 5.20 | 7.28 |

Room temperature tensile specimens prepared as described in connection with Examples 3–6 were solution treated for one hour at the temperature indicated in Table XII and were precipitation hardened as described in connection with the dilatometer specimens, and the results of the tests are listed in Table XIV.

TABLE XIV

| Ex. No. | .2% Y.S. (ksi) | U.T.S. (ksi) | El. (%) | R.A. (%) |
|---|---|---|---|---|
| 7 | 196.6 | 229.9 | 3.8 | 6.7 |
| 8 | 192.0 | 228.7 | 6.9 | 12.7 |
| 9 | 189.6 | 224.0 | 3.8 | 6.7 |
| 10 | 215.8 | 243.7 | 8.5 | 18.2 |
| 11 | 226.9 | 257.5 | 3.2 | 8.0 |

Stress rupture test data from smooth/notch stress rupture specimens are indicated in Table XV. The specimens received the same heat treatment as the specimens for Table VIII-A but the solution treatment used was that indicated in Table XII. The tests were carried out at 1200° F under a load of 105,000 psi.

TABLE XV

| Ex. No. | Stress Rupture Life (hrs.) | Elong. (%) | R.A. (%) |
|---|---|---|---|
| 7 | 409.4 | 4.1 | 7.6 |
| 8 | 95.8 | 17.1 | 29.3 |
| 9 | 90.3 | 16.1 | 42.2 |
| 10 | 352.8 | 7.4 | 23.3 |
| 11 | 499.7 | 11 | 24.7 |

As was pointed out hereinabove, various technical terms used herein are defined in said U.S. Pat. No. 3,705,827. However, it may be well to note here that by "effective solvus temperature" is meant a temperature somewhat less than the equilibrium solvus temperature above which not enough of the phase remains out of solution to have an effect on controlling the microstructure. More specifically, for the purposes of this application, the effective solvus temperature of the gamma prime and double prime phases is that temperature above which no significant aging of the alloy will occur and the effective solvus temperature of the eta and delta phases is that temperature above which so much of the eta and delta phases have been put back into solution that what remains is no longer effective to prevent grain growth and other objectionable effects.

It is to be noted that throughout this specification and in the appended claims, when the element columbium is referred to, it is to be understood as including a certain amount of tantalum, ranging from about 1% to 20% of the amount of columbium. That amount of tantalum usually is present in commercial supplies of columbium customarily used for alloying purposes. Further, additional amounts of columbium can be replaced, if desired, by tantalum. Thus, "columbium" is to be read as including tantalum or as the combined columbium plus tantalum content of the composition.

The alloy of the present invention is not only characterized by a unique combination of high temperature strength and controlled expansion properties, but it is also especially well suited for use in the fabrication of parts requiring high temperature forming techniques. In its preferred range B, the alloy of the present invention, because of its high eta and delta phase solvus temperature, can be brazed at temperatures as high as about 1800° F without significant impairment of its desired high temperature properties. Thus, this alloy is particularly useful in making parts such as blades, discs, fasteners and others for use in gas turbines.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

We claim:

1. An austenitic precipitation hardening nickel-cobalt-iron base alloy consisting essentially by weight of about

| | |
|---|---|
| Carbon | 0.1% Max. |
| Manganese | 0.50% Max. |
| Silicon | 0.50% Max. |
| Chromium | 0.5% Max. |
| Molybdenum | 0.5% Max. |
| Nickel | 35% to 40% |
| Cobalt | 13% to 17% |
| Columbium | 2.5% to 6% |
| Titanium | 1.0% to 3% |
| Aluminum | 0.1% to 2% |
| Boron | 0.003% to 0.020% |
| Vanadium | up to 1% |
| Zirconium | up to 0.1% |
| Hafnium | up to 2% |

and the balance consisting essentially of iron and incidental impurities.

2. The alloy as set forth in claim 1 containing no more than about 0.05% carbon.

3. The alloy as set forth in claim 2 containing about 0.5 to 1.5% aluminum.

4. The alloy as set forth in claim 3 containing at least about 0.005% boron.

5. The alloy as set forth in claim 4 containing about 0.01 to 0.05% carbon.

6. The alloy as set forth in claim 5 containing no more than about 0.20% manganese, and 0.20% silicon.

7. The alloy as set forth in claim 6 containing no more than about 0.015% boron.

8. The alloy as set forth in claim 7 containing 39.9% nickel, 15.9% cobalt, columbium, 2.9% titanium, 1.0% aluminum and 0.008% boron.

9. The alloy as set forth in claim 1 containing about 2.75 to 3.2% columbium, and 1.65 to 1.85% titanium.

10. The alloy as set forth in claim 9 containing about

| | |
|---|---|
| Carbon | 0.01%–0.05% |
| Nickel | 36%–39% |
| Cobalt | 14.5%–16.5% |
| Aluminum | 0.85%–1.5% |
| Boron | 0.003%–0.020% |

11. An austenitic precipitation hardening nickel-cobalt-iron base alloy consisting essentially by weight of about and the balance consisting essentially of iron and incidental impurities.

12. An austenitic precipitation hardening nickel-cobalt-iron base alloy consisting essentially by weight of about and the balance consisting essentially of iron and incidental impurities.

* * * * *

UNITED STATES PATENT OFFICE

CERTIFICATE OF CORRECTION

PATENT NO. : 4,006,011

DATED : February 1, 1977

INVENTOR(S) : Donald R. Muzyka and Donald K. Schlosser

It is certified that error appears in the above-identified patent and that said Letters Patent are hereby corrected as shown below:

Col. 1, line 58, for "velocity or" read -- variety of --. Col. 3, line 27, for "passes" read -- phases --; line 63, for "$3x10^{116}$ $^{6}$/°F" read -- $3x10^{-6}$/°F --. Col. 5, line 44, for "exclude" read -- It --; line 45, for "exlude" read -- exclude --. Col. 9, line 64, after "smooth/notch", insert -- stress --. Col. 14, Pat. Claim 8, line 2, before "columbium" insert -- 5% --. Col. 14, Pat. Claim 11, line 3, after "about" insert

| | |
|---|---|
| -- Carbon | 0.01%-0.05% |
| Manganese | 0.20% Max. |
| Silicon | 0.20% Max. |
| Chromium | 0.5% Max. |
| Molybdenum | 0.5% Max. |
| Nickel | 41.3% |
| Cobalt | 16% |
| Columbium | 4.4% |
| Titanium | 3% |
| Aluminum | 1.5% |
| Boron | 0.008% |
| Vanadium | up to 1% |
| Zirconium | up to 0.1% |
| Hafnium | up to 2% -- |

UNITED STATES PATENT OFFICE
CERTIFICATE OF CORRECTION

PATENT NO. : 4,006,011

DATED : February 1, 1977

INVENTOR(S) : Donald R. Muzyka and Donald K. Schlosser

It is certified that error appears in the above-identified patent and that said Letters Patent are hereby corrected as shown below:

Col. 14, Pat. claim 12, line 3, after "about" insert

| | |
|---|---|
| -- Carbon | 0.01%-0.05% |
| Manganese | 0.20% Max. |
| Silicon | 0.20% Max. |
| Chromium | 0.5% Max. |
| Molybdenum | 0.5% Max. |
| Nickel | 41% |
| Cobalt | 16% |
| Columbium | 5% |
| Titanium | 3% |
| Aluminum | 1.25% |
| Boron | 0.005%-0.015% |
| Vanadium | up to 1% |
| Zirconium | up to 0.1% |
| Hafnium | up to 2% -- |

Signed and Sealed this

Thirty-first Day of May 1977

[SEAL]

*Attest:*

RUTH C. MASON
*Attesting Officer*

C. MARSHALL DANN
*Commissioner of Patents and Trademarks*